United States Patent [19]

Calvert

[11] Patent Number: 4,791,774

[45] Date of Patent: Dec. 20, 1988

[54] APPARATUS FOR INTERLOCKING A PAIR OF PANELS

[75] Inventor: Rodney K. Calvert, Dunwoody, Ga.

[73] Assignee: The Mead Corporation, Dayton, Ohio

[21] Appl. No.: 138,495

[22] Filed: Dec. 24, 1987

[51] Int. Cl.[4] ..... B65B 27/04; B65B 21/24; B65B 7/24

[52] U.S. Cl. ..... 53/48; 53/374; 53/381 R

[58] Field of Search ..... 53/48, 398, 374, 381 R, 53/230, 285, 590

[56] References Cited

U.S. PATENT DOCUMENTS

| | | | |
|---|---|---|---|
| 3,182,431 | 5/1965 | Ganz | 53/48 X |
| 3,186,136 | 6/1965 | Ganz | 53/48 X |
| 3,430,413 | 3/1969 | Wood | 53/48 |
| 3,543,473 | 12/1970 | Cato | 53/48 |
| 3,557,521 | 1/1971 | Pierce, Jr. | 53/48 |
| 3,760,555 | 9/1973 | Calvert | 53/48 |
| 3,815,320 | 6/1974 | Ganz | 53/48 |
| 3,940,907 | 3/1976 | Ganz | 53/48 |
| 4,612,753 | 9/1986 | Taylor et al. | 53/48 X |

*Primary Examiner*—Horace M. Culver
*Attorney, Agent, or Firm*—Rodgers & Rodgers

[57] ABSTRACT

Apparatus for interlocking a pair of panels which may constitute the end portions of a wrap around carton blank, one of the panels having an edge strip with at least one locking aperture therein and which is foldably joined to an edge of the associated panel, the other panel being formed integrally with the body portion of a locking tab and an anchoring tab being foldably joined to the body portion of the locking tab, the apparatus including an elongated locking beam having a longitudinal locking groove formed in the lower surface thereof, means for moving a carton and its end panels along the beam and with the panels adjacent the groove, a rotatable strip folder arranged to engage and fold the strip into the locking groove so as to move its aperture out of the plane of the associated panel, a rotatable tab folder arranged to engage and fold the anchoring tab out of the plane of the body portion of the locking element, an abutment disposed in the locking groove downstream from the strip folder and tab folder for engaging and folding the anchoring tab into an acute angle relative to the body portion of the locking element, a pair of guides disposed on opposite sides of the beam for moving the panels and adjacent portions of the carton toward each other thereby to cause the locking element to move into the locking aperture and to cause the anchoring tab to engage the locking edge of the locking aperture.

16 Claims, 4 Drawing Sheets

APPARATUS FOR INTERLOCKING A PAIR OF PANELS

TECHNICAL FIELD

This invention relates to packaging one or more articles within a wrap around type carton and is concerned with apparatus for interlocking the adjacent ends of a wrap around carton blank.

BACKGROUND ART

U.S. Pat. No. 4,600,140 issued July 15, 1986 and owned by the assignee of this invention discloses and claims a panel interlocking arrangement of the type to which the apparatus of this invention is concerned.

BEST MODE OF CARRYING OUT THE INVENTION

Figure 1:
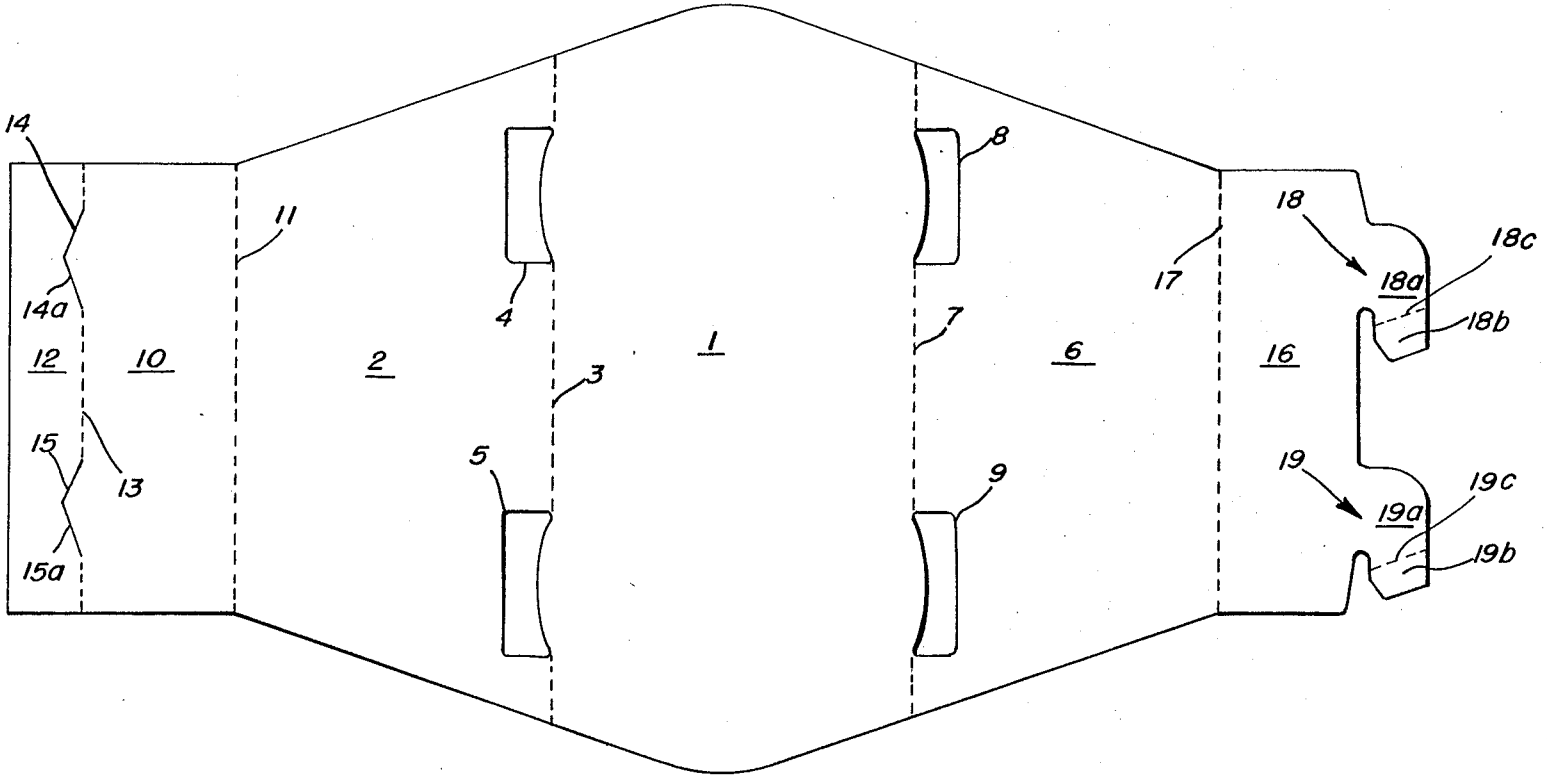
FIG. 1 is a plan view of a carton blank as viewed from the outside and to which the apparatus of this invention is applicable.

With reference to FIG. 1 the numeral 1 designates the top panel of a carton blank employed according to this invention. The numeral 2 designates a side wall foldably joined to top wall 1 along a fold line 3. Apertures 4 and 5 are formed in side wall 2 and receive the flanges of the top portions of packaged articles. Side wall 6 is foldably joined to top wall 1 along fold line 7 and apertures 8 and 9 are formed in side wall 1 and correspond to apertures 4 and 5.

A bottom panel 10 is foldably joined to the bottom edge of side wall 2 along fold line 11 and an edge strip 12 is foldably joined to bottom panel 10 along interrupted fold line 13. Locking slits 14 and 15 are formed in edge panel 12. Locking slit 14 includes a locking edge **14*a* while locking slit 15 includes a locking edge 15*a*. At the other end of the carton blank, a bottom panel 16 is foldably joined to the bottom edge of side wall 6 along fold line 17 and a pair of locking elements 18 and 19 are integrally formed with the end edge of bottom panel 16. Locking element 18 includes a base portion 18*a* and an anchoring tab 18*b* which is foldably joined to base portion 18*a* along a fold line 18*c*. Locking element 19 includes a base portion 19*a* and an anchoring tab 19*b* which is foldably joined to base portion 19*a* along fold line 19*c***.

Figure 2:
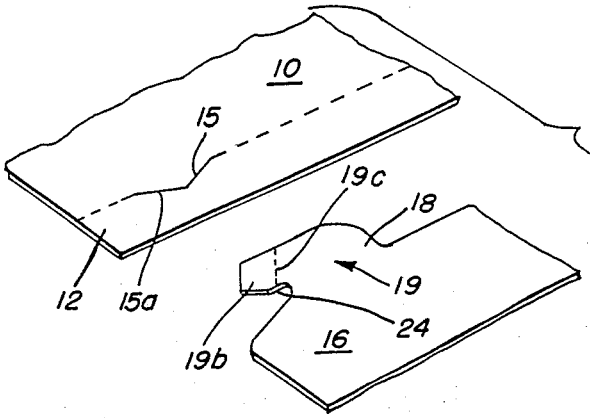
FIG. 2 is a view of panels which are to be interlocked and which may constitute the ends of the wrapper blank of FIG. 1 one end of which includes a locking tab and the other end of which includes a locking slit.
Figure 3:
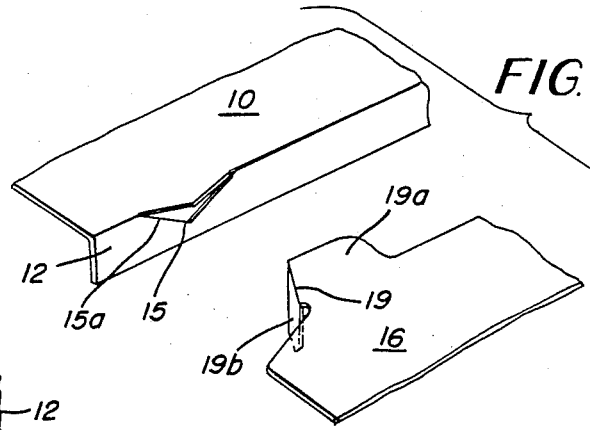
FIG. 3 is a perspective view of the panels shown in FIG. 1 prior to entry of the locking element into the locking slit of the other panel and with an anchoring tab folded out of the plane of the body portion of the locking element.
Figure 4:
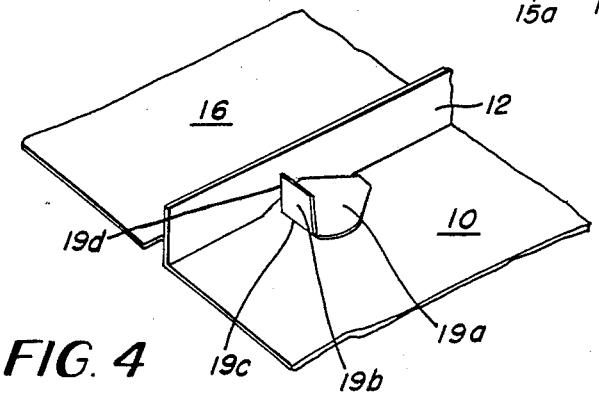
FIG. 4 is a view of the panels shown in FIGS. 2 and 3 but with the panels viewed from the opposite surfaces thereof and with the anchoring tab folded out of the plane of the body portion of the locking element.

As is apparent from FIG. 2, panels 10 and 16 are disposed adjacent each other. FIG. 3 shows edge panel 12 folded into a vertical position and with anchoring tab **19*b* folded out of the plane of the base portion 19*a* of locking element 19. FIG. 4 shows the locking element 19 inserted through the slit 15 and with the anchoring tab 19*b* folded out of the plane of base portion 19*a* and with an edge 19*d* in abutment with a locking edge 15*a* of slit 15**.

Figure 5:
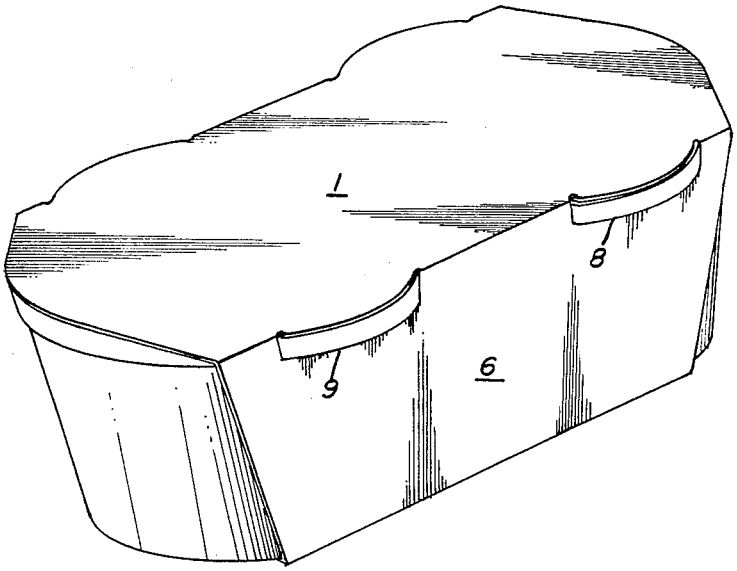
FIG. 5 shows a set up carton formed by the apparatus of this invention.

As is apparent from FIG. 5, the completely set up carton includes two packaged cups such as might be used for dispensing margarine for example.

Figure 6:
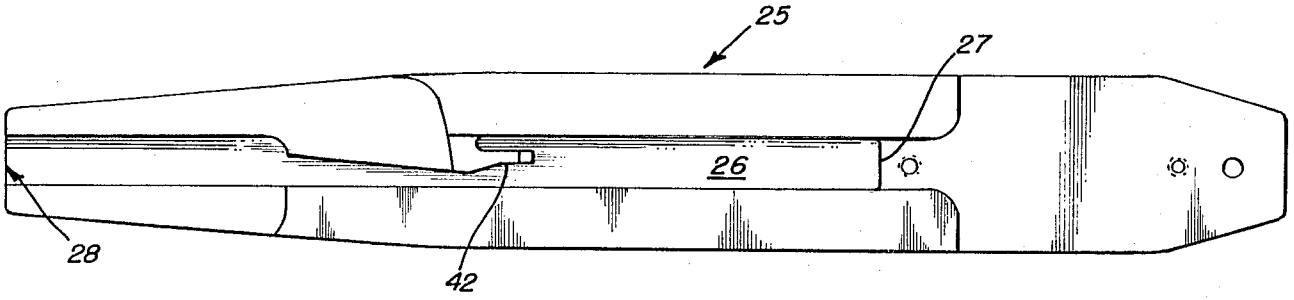
FIG. 6 is a plan view of a longitudinal beam formed according to this invention as viewed from underneath.

FIG. 6 discloses an elongated beam formed according to this invention and which shows the beam as viewed from underneath so as to show the parts of the beam which cooperate with the locking elements of the panels to be interlocked. Thus in FIG. 6 the beam is generally designated at 25 and includes a groove generally designated at 26 which extends from the point designated at 27 to the left and to the end designated 28 of the beam 25.

Figure 11:
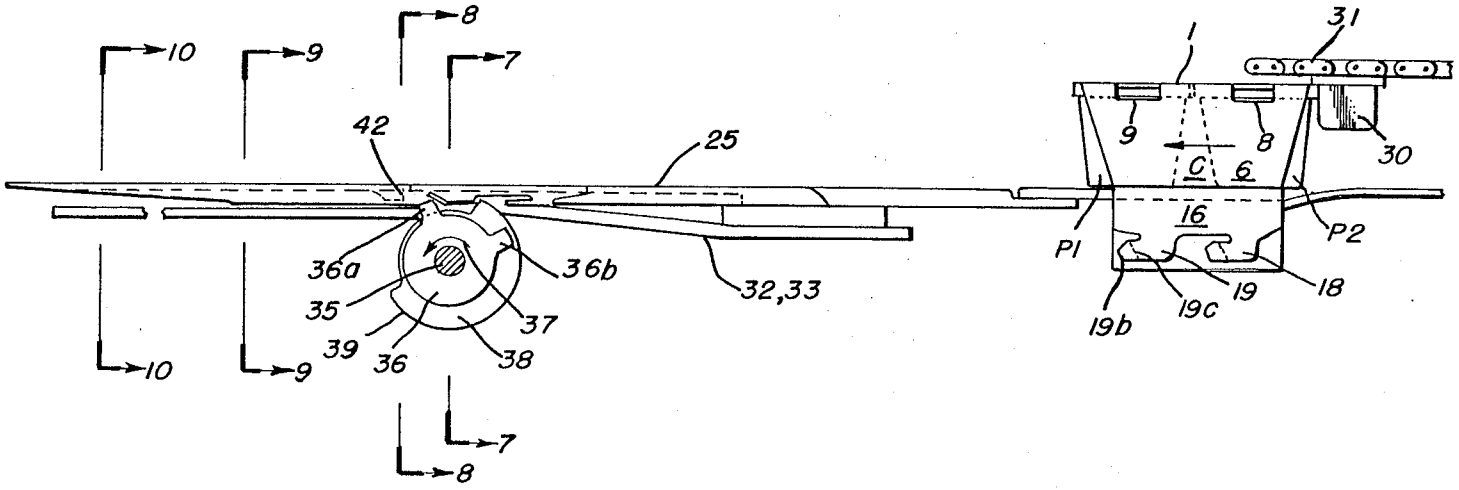
FIG. 11 is a view of the machine which shows the longitudinal beam and associated parts as viewed in their correct positions from one side of the apparatus.

As is shown in FIG. 11, the carton blank C and its articles P1 and P2 enter the infeed end of the beam 25 and move along its smooth upper surface toward the left. Carton side wall 6 is apparent together with bottom panel 16 and locking elements 18 and 19. Packages P1 and P2 are partially exposed at the ends of the carton blank C. Movement is imparted to the assembly of the carton and packages P1 and P2 by suitable means such as blocks 30 on movable chain 31 which parts are shown in a fragmentary fashion so as to avoid undue complication of the drawing. Each succeeding carton is pushed by a blank on chain 31.

Figure 7:
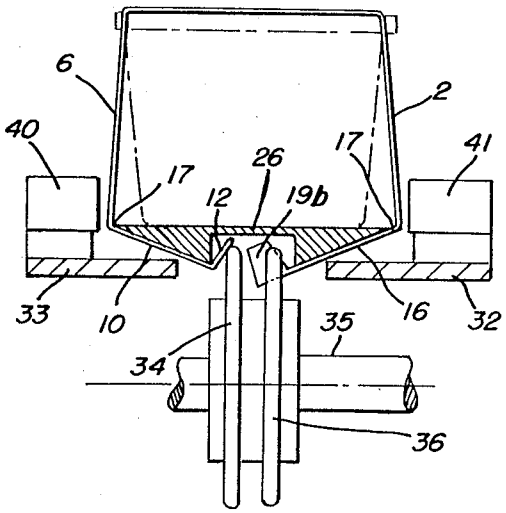
FIG. 7 is a cross sectional view taken along the line designated 7—7 in FIG. 11.

As the assembly shown at C in FIG. 11 moves toward the left, bottom panel 16 is folded inwardly along fold line 17 by means of static folder 32 best shown in FIG. 7. Similarly, bottom panel 10 is folded inwardly along fold line 11 by static folder 33 as best shown in FIG. 7. During this operation, strip 12 is folded to the position shown in FIG. 7 by strip folder 34 which is rotatable and mounted on a shaft 35 which is disposed in a transverse relation to the orientation of the beam 25.

Simultaneously, a radial element such as **36*a* or 36*b* of tab folder 36 engages anchoring tab such as 19*b* and folds that tab along its fold line 19*c* into a position of angular relationship relative to the body portion 19*a* of folding element 19. Tab folder 36 and strip folder 34 are rigidly secured to shaft 35 and thus rotate in unison. At the stage represented by FIG. 7, a pair of static guides 40 and 41 disposed on opposite sides of the carton engage the lower portions of the side walls 6 and 2 and maintain the bottom panels 10 and 16 in the positions represented in FIG. 7. As is apparent in FIG. 11, radial elements 36*a* and 36*b* engage the anchoring tabs 18*b* and 19*b*, the rotatable element 36 being rotatable in a counterclockwise direction as indicated by the arrow 37. Also from FIG. 11 it is apparent that the strip folder 38 includes a peripheral segment 39 which is arranged as explained to engage the strip 12 and to fold that strip relative to the bottom panel 10 as indicated for example in FIG. 7. Preferably peripheral segment 39 is somewhat shorter than the length of edge strip 12**.

Figure 8:
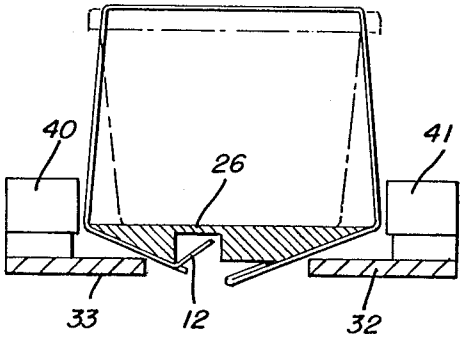
FIG. 8 is a cross sectional view taken along the line designated 8—8 in FIG. 11.
Figure 9:
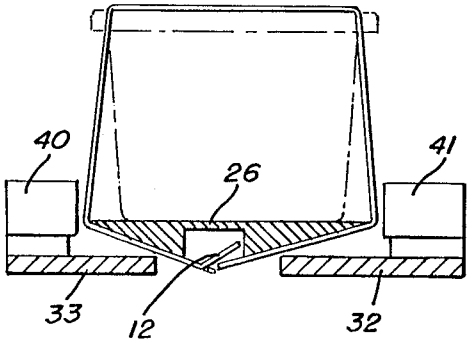
FIG. 9 is a cross sectional view taken along the line designated 9—9 in FIG. 11.
Figure 10:
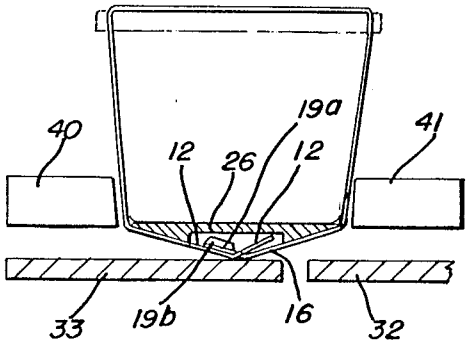
FIG. 10 is a cross sectional view taken along the line designated 10—10 in FIG. 11.

FIGS. 8, 9 and 10 are similar to FIG. 7 and simply depict subsequent phases of the panel interlocking operation which becomes complete as represented in FIG. 10. Of course during this interlocking operation, the guides 40 and 41 are configured somewhat differently so as to effect desired manipulation of the side walls. In similar fashion the configuration of the folders 32 and 33 changes as the interlocking operation progresses so as to effect the desired manipulation of the locking elements.

It should be pointed out that the final positioning of the anchoring tabs such as 18*b* and 19*b* is effected by the abutment surface 42 which engages the anchoring tabs such as 18*b* and 19*b* following their movement out of the planes of the body portions 18*a* and 19*a* of locking element 18 and 19 respectively. Of course the completed carton is then moved off of the left hand end of the beam 25.

From FIGS. 7 to 10 it is apparent that the depth of groove 26 becomes progressively less as the interlocking operation progresses and that the bottom of the beam is configured so that its thickness adjacent the edges of the groove 26 is greater than at the side edges of the beam so as to hold the panels 10 and 16 at oblique angles during an interlocking operation.

Also the width of the beam 25 becomes narrower at the outfeed end thereof.

Of course the folding operations are performed in synchronism with the operation of chain 31 and blades 30.

When the interlocking operation is complete, the anchoring tab such as 19*b* as best shown in FIG. 10 is in close proximity and almost in flat face contacting relation with the base portion 19*a* of the locking element 19 with the locking edge 19*d* of anchoring tab 19*a* in firm contact with the locking edge 15*a* of locking slit 15.

With the locking arrangement as disclosed, the carton is securely and efficiently closed effectively retains the contents such as P1 and P2.

I claim:

1. Apparatus for interlocking a first panel with a second panel, said first panel having a locking strip with at least one locking slit having a locking edge and said strip being foldably joined along an edge thereof to said first panel a second panel having at least one locking element integrally formed with an edge of said second panel and having a body portion and an anchoring tab foldably joined to said body portion, said apparatus comprising an elongated locking beam having a longitudinal locking groove formed along one surface thereof, means for moving said panels along said beam and adjacent said groove, a rotatable strip folder mounted on a rotatable shaft disposed in transverse relation to said beam and arranged to engage and fold said strip into said locking groove so as to move its aperture out of the plane of said first panel, a rotatable tab folder mounted on said shaft and arranged to engage and fold said anchoring tab out of the plane of said body portion of said locking element, an abutment disposed in said locking groove downstream from said strip folder and said tab folder for engaging and folding said anchoring tab into an acute angular relation to said body portion of said locking element, a pair of guides disposed on opposite sides of said beam for moving said panels toward each other thereby to cause said locking element to move into said locking slit and to cause said anchoring tab to engage said locking edge of said locking slit.

2. Apparatus according to claim 1 wherein said first and second panels constitute a composite panel of a tubular carton when interlocked.

3. Apparatus according to claim 1 wherein a plurality of locking apertures are formed in said locking strip and a plurality of corresponding locking elements are disposed along said edge of said second panel.

4. Apparatus according to claim 1 wherein a pair of static folders are disposed adjacent said beam and on opposite sides thereof for engaging and positioning said panels relative to said groove.

5. Apparatus according to claim 1 wherein said tab folder comprises radial tab engaging elements corresponding to the number of locking elements on said second panel.

6. Apparatus according to claim 1 wherein said strip folder includes a strip engaging segment having a peripheral dimension somewhat less than the length of said edge strip.

7. Apparatus according to claim 1 wherein said first and second panels are foldably joined respectively to the lower edges of the side walls of a wraparound sleeve type carton.

8. Apparatus according to claim 1 wherein said groove is formed in the lower surface of said beam.

9. Apparatus according to claim 8 wherein articles to be packaged are supported by the upper surface of said beam.

10. Apparatus according to claim 9 wherein the articles and carton blank are moved along said beam while said panels are being interlocked.

11. Apparatus according to claim 1 wherein the depth of said groove becomes progressively less as the interlocking operation is performed.

12. Apparatus according to claim 8 wherein the bottom of said beam is configured so that its thickness adjacent the opposite edges of said groove is greater than at the side edges of said beam so as to hold said panels at oblique angles to each other during the interlocking operation.

13. Apparatus according to claim 1 wherein said strip folder and said tab folder rotate in unison.

14. Apparatus according to claim 13 wherein said strip folder and said tab folder are rigidly mounted on and rotatable with said shaft.

15. Apparatus according to claim 1 wherein said strip folder and said tab folder are rotated in synchronism with said means for moving said panels along said beam.

16. Apparatus according to claim 1 wherein the transverse width of said beam becomes progressively less during a panel interlocking operation.

* * * * *